US009352888B2

(12) United States Patent
Scott

(10) Patent No.: US 9,352,888 B2
(45) Date of Patent: May 31, 2016

(54) SHIPPING CONTAINER WITH GRIPS AND LOCKING PORTS

(76) Inventor: William Mitchell Scott, Villa Hills, KY (US)

( * ) Notice: Subject to any disclaimer, the term of this patent is extended or adjusted under 35 U.S.C. 154(b) by 721 days.

(21) Appl. No.: 13/606,059

(22) Filed: Sep. 7, 2012

(65) Prior Publication Data

US 2014/0069059 A1 Mar. 13, 2014

(51) Int. Cl.

| | |
|---|---|
| ***B65D 55/02*** | (2006.01) |
| ***B65D 5/68*** | (2006.01) |
| ***B65D 5/468*** | (2006.01) |
| ***B65D 5/66*** | (2006.01) |

(52) U.S. Cl.

CPC ..... *B65D 55/02* (2013.01); *B65D 5/4608* (2013.01); *B65D 5/6602* (2013.01); *B65D 5/68* (2013.01)

(58) Field of Classification Search

CPC .... B65D 55/02; B65D 5/6602; B65D 5/4608; B65D 5/68; B65D 55/14; E05B 73/0017; E05B 73/0029; B60K 15/0409

USPC ..... 206/1.5, 315.1, 315.3; 70/159, 158, 70/163; 229/117.16, 125.19, 145

See application file for complete search history.

(56) References Cited

U.S. PATENT DOCUMENTS

| | | | | |
|---|---|---|---|---|
| 238,117 | A | | 2/1881 | Hillman |
| 600,879 | A | | 3/1898 | Louden |
| 650,624 | A | | 5/1900 | Webb |
| 1,198,435 | A | | 9/1916 | Gebart |
| 1,302,361 | A | | 4/1919 | Gordon |
| 1,457,770 | A | | 6/1923 | Dodge |
| 1,465,691 | A | | 8/1923 | Snedeker |
| 1,623,547 | A | | 4/1927 | Neumann |
| 1,690,852 | A | * | 11/1928 | Behrman ..... B65D 5/68 229/102 |
| 1,865,688 | A | | 7/1932 | Hannaford |
| 1,897,672 | A | | 2/1933 | Neumann |
| 1,955,663 | A | | 4/1934 | Wendell et al. |
| 1,974,674 | A | | 9/1934 | Halladay et al. |
| 2,019,371 | A | | 10/1935 | Tompkins |
| 2,054,355 | A | | 9/1936 | Anderson, Jr. |

(Continued)

FOREIGN PATENT DOCUMENTS

| | | |
|---|---|---|
| JP | 52171526 | 12/1977 |
| JP | 7-35313 | 6/1995 |

(Continued)

OTHER PUBLICATIONS

Acrylic Desktop File Holder; http://www.alibaba.com/product-gs/541368370/acrylic_desktop_file_holder.html; Copyright © 1999-2012 Alibaba.com Hong Kong Limited and licensors; printed Oct. 24, 2012; p. 1-3.

(Continued)

*Primary Examiner* — Steven A. Reynolds

(74) *Attorney, Agent, or Firm* — Patents on Demand, P.A.; Brian K. Buchheit; Scott M. Garrett

(57) ABSTRACT

A corrugated shipping container having an elongated container body with an open end, and a lid to cover the open end. The lid and container have a through-lid grip opening and one or more through-lid locking ports for locking the lid to the container body with a cable tie. The through-lid grip opening is configured with an ergonomic profile to improve the lifting, handling and carrying of the shipping container, particularly when weighed with shipping articles, such as a golf bag and set of golf clubs.

12 Claims, 11 Drawing Sheets

(56) References Cited

U.S. PATENT DOCUMENTS 2,076,065 A 4/1937 Kenneth
2,094,054 A 9/1937 Bixby
2,103,373 A * 12/1937 McClure ..... B65D 5/4295 229/117.12
2,124,409 A 7/1938 Andrews
RE21,386 E 3/1940 Crawford
2,201,462 A 5/1940 Wells et al.
2,218,509 A 10/1940 Goodyear
2,249,265 A 7/1941 Bauder
2,253,008 A 8/1941 Anderson, Jr.
2,289,619 A 7/1942 Anderson, Jr.
2,297,284 A 9/1942 Blackman
2,307,349 A 1/1943 Anderson, Jr.
2,307,350 A 1/1943 Anderson, Jr.
2,330,294 A 9/1943 Leavitt et al.
2,365,182 A 12/1944 Ferguson
2,418,963 A 4/1947 Anderson, Jr.
2,460,230 A 1/1949 Makrianes
2,487,302 A 11/1949 Bradley
2,523,908 A 9/1950 Johnsen
2,537,801 A * 1/1951 Swatsick ..... 229/125.21
2,544,283 A 3/1951 Snyder
2,559,552 A 7/1951 Welshenbach
2,561,979 A 7/1951 George
2,564,948 A 8/1951 Beck, Jr. et al.
2,597,847 A 5/1952 Reeser
2,604,255 A 7/1952 Welshenbach
2,629,499 A 2/1953 Welshenbach
2,634,038 A 4/1953 George et al.
2,645,353 A 7/1953 Anderson, Jr.
2,654,527 A 10/1953 Geckler et al.
2,698,124 A 12/1954 Hines
2,757,853 A 8/1956 Main
2,769,550 A 11/1956 Rollins et al.
2,788,933 A 4/1957 Kessler
2,822,973 A * 2/1958 Armstrong et al. ..... 229/125.21
2,827,222 A 3/1958 Buttery
D186,672 S 11/1959 Gilruth
2,925,210 A 2/1960 Fallert
2,981,455 A 4/1961 Cope
3,002,650 A 10/1961 Lovell
3,005,717 A 10/1961 Pilibos
3,049,279 A 8/1962 Mairs et al.
3,107,041 A 10/1963 Wagner, Jr.
3,112,058 A 11/1963 Martin
3,114,493 A 12/1963 Dunkin
3,116,007 A * 12/1963 D Esposito et al. ..... 229/125.26
3,118,588 A 1/1964 Noble
3,138,283 A 6/1964 Peebles
3,155,235 A 11/1964 Maich
D200,699 S 3/1965 Pappas
3,175,750 A 3/1965 Bump
3,186,586 A 6/1965 Box
3,195,798 A 7/1965 Wilson
3,206,098 A 9/1965 Stenger
3,270,946 A 9/1966 Redpath
D206,304 S 11/1966 Pinzke
3,282,462 A 11/1966 Box
3,301,386 A 1/1967 Carter
3,301,461 A 1/1967 Kroeschell
3,314,532 A 4/1967 Henry
3,366,496 A 1/1968 Bomar et al.
3,379,341 A 4/1968 Miles
3,391,698 A 7/1968 Wiles
3,392,904 A 7/1968 Wei
3,396,898 A 8/1968 Dorfman
3,438,562 A * 4/1969 Wright et al. ..... 229/117.02
3,568,918 A 3/1971 Blomqvist
3,596,391 A 8/1971 Knight, Jr.
3,622,036 A 11/1971 McVeigh
3,664,494 A 5/1972 Mergens
3,667,666 A 6/1972 Pryor
3,670,949 A 6/1972 Galanes
3,684,159 A 8/1972 Wolfe
3,692,231 A 9/1972 Neitzke et al.
3,698,625 A 10/1972 Graser
3,713,579 A 1/1973 Chaffers
3,724,920 A 4/1973 Beck
3,727,827 A 4/1973 Stice
3,774,332 A 11/1973 Schneider
3,797,731 A 3/1974 Weldon
3,815,808 A * 6/1974 Bunnell ..... 206/427
3,831,834 A 8/1974 Elward
3,844,473 A 10/1974 Whelan
3,860,113 A 1/1975 Helms
3,862,687 A 1/1975 Pirman
3,910,483 A 10/1975 Ritter
3,952,940 A 4/1976 Malcolm
D242,021 S 10/1976 Shanklin
4,030,600 A * 6/1977 Heaps ..... 206/597
D244,994 S 7/1977 Flanagan
4,082,215 A 4/1978 Eichenauer
4,101,052 A * 7/1978 Dove ..... 229/101
4,114,300 A 9/1978 Holson
4,127,228 A 11/1978 Hall
4,142,665 A 3/1979 Jewell et al.
4,172,522 A 10/1979 Muller et al.
4,184,625 A 1/1980 Stollberg et al.
4,199,832 A 4/1980 Glasscock et al.
4,201,330 A * 5/1980 Gilbert ..... 229/117.16
4,228,904 A 10/1980 Dumond
4,230,261 A 10/1980 Austin
4,265,391 A 5/1981 Zornes et al.
4,285,150 A 8/1981 Richardson et al.
4,291,830 A 9/1981 Sorensen
D263,899 S 4/1982 Lynn
4,325,493 A 4/1982 Paige
4,339,069 A 7/1982 Poteet
4,356,952 A 11/1982 Rekow
4,380,290 A 4/1983 Luebke
D269,251 S 6/1983 Fraze
D271,607 S 11/1983 Aspenwall
4,504,497 A 3/1985 Kurth et al.
4,531,667 A 7/1985 Meade
4,542,832 A 9/1985 Minick et al.
4,588,077 A 5/1986 Champlin et al.
4,617,702 A 10/1986 Diederich, Jr.
4,655,366 A 4/1987 Sykes
4,717,023 A 1/1988 Oprean
D297,214 S 8/1988 Forbes, Jr.
4,768,704 A 9/1988 Beckway et al.
4,817,861 A 4/1989 Henrikson
4,830,268 A 5/1989 Pitts
4,838,436 A 6/1989 Bailey
4,854,060 A 8/1989 Corbo et al.
4,905,834 A 3/1990 Mur Gimeno et al.
4,927,074 A * 5/1990 LaRue et al. ..... 229/125.21
4,948,033 A 8/1990 Halsell, II et al.
4,961,497 A 10/1990 Sherer et al.
D312,402 S 11/1990 Boggus, Jr.
D312,531 S 12/1990 Sherer et al.
D315,098 S 3/1991 Hutcheson
5,011,071 A 4/1991 Lopez
5,016,814 A 5/1991 Fullerton
5,022,527 A * 6/1991 Braeutigam ..... 206/522
5,042,657 A 8/1991 Dunn
5,042,715 A 8/1991 McNeill
5,064,069 A 11/1991 Su
5,076,491 A 12/1991 Freudentahl et al.
D326,341 S 5/1992 Frauhiger
5,111,957 A 5/1992 Hollander et al.
5,119,950 A 6/1992 Takemura
5,148,942 A 9/1992 Snook
5,148,973 A 9/1992 Zimmerman
5,156,328 A * 10/1992 Wozniacki ..... B65D 5/68 229/125.22
5,295,632 A 3/1994 Zink et al.
5,322,167 A 6/1994 Birutis et al.
D348,390 S 7/1994 Van Ness
5,333,777 A 8/1994 Roth
5,335,844 A 8/1994 Young
5,402,932 A 4/1995 Fadaie
5,411,145 A 5/1995 Parks
5,429,295 A 7/1995 Levy

(56) References Cited

U.S. PATENT DOCUMENTS

D361,892 S 9/1995 Quaintance
5,494,161 A 2/1996 Herbst
5,503,324 A 4/1996 Bacchetti et al.
5,505,371 A 4/1996 O'Neill
5,522,628 A 6/1996 Fillis
D372,673 S 8/1996 Turner
5,570,834 A 11/1996 Larson et al.
5,579,917 A 12/1996 Lofgren et al.
5,699,959 A * 12/1997 Huspeka ..... B65D 5/685 229/125.26
D391,079 S 2/1998 Conti et al.
D394,950 S 6/1998 Kite
5,765,695 A 6/1998 Picciallo
5,779,129 A 7/1998 Herbst et al.
5,794,780 A 8/1998 Parrella et al.
D398,228 S 9/1998 Herbst et al.
D398,230 S 9/1998 Herbst et al.
D399,366 S 10/1998 Stravitz
5,826,728 A 10/1998 Sheffer
5,839,650 A 11/1998 Sheffer
5,884,783 A 3/1999 Proulx
5,887,782 A 3/1999 Mueller
5,890,650 A 4/1999 Penson
5,908,152 A 6/1999 Tullis
D419,302 S 1/2000 Hardy et al.
D420,704 S 2/2000 Coe
D421,183 S 2/2000 Koskinen
6,036,042 A 3/2000 Pietruch et al.
D422,499 S 4/2000 Herbst et al.
D423,587 S 4/2000 Conley et al.
D424,117 S 5/2000 Steinbeck et al.
D425,128 S 5/2000 Conley et al.
D425,562 S 5/2000 Conley et al.
6,059,180 A 5/2000 Collins
6,070,719 A 6/2000 Pollock
6,098,873 A 8/2000 Sheffer
6,116,498 A * 9/2000 Sheffer ..... 229/114
6,123,254 A 9/2000 Dupuis
6,135,347 A 10/2000 Mueller
D434,223 S 11/2000 Dombrowski
6,149,052 A 11/2000 Mueller
6,164,461 A 12/2000 Ward et al.
D436,728 S 1/2001 Harding
D441,653 S 5/2001 LeRoux
D442,780 S 5/2001 Hiernard
6,237,840 B1 5/2001 Grabowski et al.
D443,592 S 6/2001 Frattini
6,256,914 B1 7/2001 Yeh
6,290,124 B2 9/2001 Andrews, Sr. et al.
D448,567 S 10/2001 Buss
D448,568 S 10/2001 Sadr
6,311,891 B1 11/2001 Gardner
D451,675 S 12/2001 Hardy et al.
D453,275 S 2/2002 Stravitz
6,352,157 B1 3/2002 Srinivasan
D461,120 S 8/2002 Ostro
D461,125 S 8/2002 Decello et al.
6,439,452 B1 8/2002 Tsao
6,499,781 B1 12/2002 Flynn
D468,638 S 1/2003 Nogami et al.
6,520,607 B2 2/2003 Pfaff
6,527,167 B1 3/2003 Sheffer
D477,165 S 7/2003 Petri
D477,217 S 7/2003 Riedi
6,604,675 B2 8/2003 Southwell
6,619,540 B1 9/2003 Bazany
D480,273 S 10/2003 Cordwell
6,641,032 B1 11/2003 Schilling
6,669,080 B2 12/2003 Ong
D485,466 S 1/2004 Haruhiro
6,705,515 B2 3/2004 Dowd
6,708,874 B1 3/2004 Montgomery
6,719,191 B1 4/2004 Christensen et al.
D494,759 S 8/2004 Louie et al.
D495,490 S 9/2004 Garrett et al.
6,792,709 B1 9/2004 Fine et al.
6,830,156 B2 12/2004 MacKelvie
6,854,915 B1 2/2005 Ong
D503,614 S 4/2005 Sax et al.
6,889,893 B2 5/2005 Kent
D507,404 S 7/2005 Moon et al.
D508,042 S 8/2005 Oikawa
D510,521 S 10/2005 Lebras
D510,823 S 10/2005 Ng et al.
D518,526 S 4/2006 Benn
D518,708 S 4/2006 Ohayon
D526,357 S 8/2006 Killinger et al.
D526,893 S 8/2006 Nixon
D527,424 S 8/2006 Long
D536,964 S 2/2007 Smith et al.
D539,036 S 3/2007 Potts et al.
D542,033 S 5/2007 Kopenhaver et al.
7,210,614 B2 5/2007 Mazurek
D548,072 S 8/2007 Nixon
D548,782 S 8/2007 Nash
D549,096 S 8/2007 Ayats et al.
D549,575 S 8/2007 Pinkstone
D551,860 S 10/2007 Northrop
D558,047 S 12/2007 Pinkstone
D561,023 S 2/2008 Jacxsens et al.
7,331,451 B2 2/2008 Focke et al.
D569,105 S 5/2008 Van Hoorn
D570,684 S 6/2008 Kisch
7,387,350 B2 6/2008 Killinger et al.
D575,452 S 8/2008 Jones et al.
7,410,094 B2 8/2008 Bos
7,438,198 B2 10/2008 Pickles
D581,782 S 12/2008 Kisch
D583,660 S 12/2008 Steiger et al.
D587,996 S 3/2009 Steiger et al.
D599,202 S 9/2009 Whiteside
7,611,020 B2 11/2009 Prest
D610,000 S 2/2010 Schantz
7,654,408 B2 2/2010 Bazany
D610,904 S 3/2010 Russell et al.
D612,248 S 3/2010 Safdieh
D613,899 S 4/2010 Whittier et al.
D614,484 S 4/2010 Schantz
D615,775 S 5/2010 Fairbanks
D617,185 S 6/2010 Wager
7,726,552 B2 6/2010 Chadima
D619,453 S 7/2010 Petaccia
D622,140 S 8/2010 Elhalwani
D623,512 S 9/2010 Stewart
D623,513 S 9/2010 Kelly
D627,562 S 11/2010 Osiecki et al.
D629,163 S 12/2010 Sullivan
D633,296 S 3/2011 Potts et al.
D641,620 S 7/2011 Hammond et al.
D643,302 S 8/2011 Stone
D651,076 S 12/2011 Van Berlo
8,079,474 B1 12/2011 Flaming
D657,562 S 4/2012 McNamara
D657,748 S 4/2012 Hargreaves et al.
8,152,050 B2 4/2012 Busam et al.
D658,407 S 5/2012 Pung et al.
D661,096 S 6/2012 Dretzka
D662,133 S 6/2012 Smith et al.
8,220,701 B2 7/2012 Fontaine et al.
D665,846 S 8/2012 Chuang
8,251,276 B2 8/2012 McLeod
D666,830 S 9/2012 Glenn
D671,321 S 11/2012 Scott
D671,322 S 11/2012 Scott
D671,323 S 11/2012 Scott
D673,368 S 1/2013 Scott
D673,369 S 1/2013 Post et al.
D675,443 S * 2/2013 Scott ..... D3/307
D678,058 S 3/2013 Vanden Boom et al.
D679,094 S 4/2013 Scott
D680,427 S 4/2013 Macaulay et al.
D680,428 S 4/2013 Vanden Boom et al.
D681,331 S * 5/2013 Scott ..... D3/302
D681,953 S 5/2013 Scott

(56) References Cited

U.S. PATENT DOCUMENTS

| | | | | | |
|---|---|---|---|---|---|
| D685,264 | S | | 7/2013 | Lai et al. | |
| D685,634 | S | * | 7/2013 | Scott | D9/432 |
| D685,649 | S | | 7/2013 | Banuelos | |
| D690,105 | S | | 9/2013 | Scott | |
| D690,106 | S | | 9/2013 | Scott | |
| D690,107 | S | | 9/2013 | Scott | |
| D690,126 | S | | 9/2013 | Ogawa | |
| D698,152 | S | | 1/2014 | Scott | |
| D702,546 | S | | 4/2014 | McAdams | |
| D709,704 | S | | 7/2014 | Scott | |
| D710,442 | S | | 8/2014 | Stravitz | |
| D711,108 | S | | 8/2014 | Scott | |
| D711,738 | S | * | 8/2014 | Scott | D9/434 |
| D712,251 | S | * | 9/2014 | Scott | D9/434 |
| D712,475 | S | | 9/2014 | Scott | |
| D712,476 | S | | 9/2014 | Scott | |
| 9,051,075 | B2 | * | 6/2015 | Scott | |
| 2001/0052477 | A1 | | 12/2001 | McNeill | |
| 2002/0108279 | A1 | | 8/2002 | Hubbard, II et al. | |
| 2002/0124451 | A1 | | 9/2002 | Ong | |
| 2002/0125308 | A1 | | 9/2002 | McLeod | |
| 2003/0168502 | A1 | | 9/2003 | Kisch | |
| 2003/0183679 | A1 | | 10/2003 | Ong | |
| 2004/0226210 | A1 | | 11/2004 | Kaur | |
| 2005/0029260 | A1 | | 2/2005 | Sheng-Bin | |
| 2005/0241971 | A1 | | 11/2005 | Zou et al. | |
| 2005/0284906 | A1 | | 12/2005 | Potts et al. | |
| 2006/0022026 | A1 | | 2/2006 | Yandian et al. | |
| 2006/0054669 | A1 | | 3/2006 | Hsieh | |
| 2006/0054674 | A1 | | 3/2006 | Meyer | |
| 2006/0243784 | A1 | | 11/2006 | Glaser et al. | |
| 2006/0266807 | A1 | | 11/2006 | Shook | |
| 2007/0051787 | A1 | | 3/2007 | Schille et al. | |
| 2007/0272630 | A1 | | 11/2007 | DeLuca | |
| 2008/0054059 | A1 | * | 3/2008 | Chadima | 229/125.38 |
| 2008/0093233 | A1 | | 4/2008 | Jones et al. | |
| 2008/0173703 | A1 | | 7/2008 | Westerman et al. | |
| 2009/0020444 | A1 | | 1/2009 | Green | |
| 2009/0173774 | A1 | | 7/2009 | Schemmel et al. | |
| 2009/0282843 | A1 | | 11/2009 | Brand | |
| 2010/0314268 | A1 | | 12/2010 | Goodman | |
| 2010/0314435 | A1 | | 12/2010 | Goodman | |

FOREIGN PATENT DOCUMENTS

| | | | |
|---|---|---|---|
| JP | 08230870 | | 9/1996 |
| JP | 10152125 | | 6/1998 |
| JP | 2000335157 | | 12/2000 |
| JP | 2001063265 | | 3/2001 |
| JP | 2001-1294231 | A | 10/2001 |
| JP | 2003026157 | | 1/2003 |
| JP | 2003191946 | | 7/2003 |
| JP | 2004526633 | | 9/2004 |
| JP | 2006021808 | | 1/2006 |
| JP | 2009029481 | | 2/2009 |
| WO | WO 99/25621 | | 5/1999 |
| WO | 2006063008 | | 6/2006 |

OTHER PUBLICATIONS

Acrylic Magazine Holder (m Shape); http://www.alibaba.com/product-gs/274660307/Acrylic_magazine_holder_M_shape_.html; Copyright ©1999-2012 Alibaba.com Hong Kong Limited and licensors; printed Oct. 24, 2012; p. 1-2.

Zigzag Acrylic Literature http://www.alibaba.com/product-gs/294904097/zigzag_acrylic_literature_magazine_holder_acrylic.html; Copyright ©1999-2012 Alibaba.com Hong Kong Limited and licensors; printed Oct. 24, 2012; p. 1-3.

Kanteck Acrylic Mini Sorter—KTKAD50; http://www.discountofficeitems.com/office-supplies/desk-organizers/desk -organizers-holders/desktop-file-sorters/kantek-acrylic-mini-sorter/p14879.html; Cart Reference # DGL1647F; Copyright © 2012 DiscountOfficeItems.com; printed Oct. 24, 2012; p. 1-3.

Lebon, Hilary (Social Media Pro/Consultant) Marketing Idea for the Day—Corrugated Plastic Totes; http://www.mdi.org/index.php/marketing-idea-for-the-day-corrugated-plastic-totes/; Jun. 28, 2011; Copyright © 2010 MDI; p. 1-3.

PCT Search Report and Written Opinion for Corresponding PCT Application No. PCT/US2012/036980; mailed Dec. 3, 2012; pp. 1-9.

Photo 1 of United States Postal Service bin; published prior to Apr. 28, 2012.

Photo 2 of United States Postal Service bins; published prior to Apr. 28, 2012.

Screen Shot of No. 1555 tote and 1560 tote; published prior to Apr. 28, 2012.

William M. Scott, U.S. Appl. No. 13/441,434, Container With Grips, filed Apr. 6, 2012.

William M. Scott, U.S. Appl. No. 13/448,349, Strengthening Insert for a Corrugated Box, filed Apr. 16, 2012.

William M. Scott, U.S. Appl. No. 29/391,489, Novel Box, filed May 9, 2011.

William M. Scott, U.S. Appl. No. 29/391,490, Novel Box & Private Label, filed May 10, 2011.

William M. Scott, U.S. Appl. No. 29/391,491, Box, filed May 10, 2011.

William M. Scott, U.S. Appl. No. 29/391,492, Box, filed May 10, 2011.

William M. Scott, U.S. Appl. No. 29/419,400, Box With Locking Ports, filed Apr. 27, 2012.

William M. Scott, U.S. Appl. No. 29/419,603, Box, filed Apr. 30, 2012.

William M. Scott, U.S. Appl. No. 29/438,590, Box, filed Nov. 30, 2012.

William M. Scott, U.S. Appl. No. 29/419,507, Carrying Tote, filed Apr. 28, 2012.

William M. Scott, U.S. Appl. No. 29/438,066, Carrying Tote, filed Nov. 26, 2012.

William M. Scott, U.S. Appl. No. 29/419,508, Carrying Tote, filed Apr. 28, 2012.

William M. Scott, U.S. Appl. No. 29/438,072, Carrying Tote, filed Nov. 26, 2012.

William M. Scott, U.S. Appl. No. 29/419,510, Carrying Tote, filed Apr. 28, 2012.

William M. Scott, U.S. Appl. No. 29/438,077, Carrying Tote, filed Nov. 26, 2012.

William M. Scott, U.S. Appl. No. 29/431,415, Box, filed Sep. 7, 2012.

William M. Scott, U.S. Appl. No. 29/431,416, Box, filed Sep. 7, 2012.

William M. Scott, U.S. Appl. No. 29/431,417, Box, filed Sep. 7, 2012.

William M. Scott, U.S. Appl. No. 13/606,059, Shipping Container With Grips and Locking Ports, filed Sep. 7, 2012.

William M. Scott, U.S. Appl. No. 29/431,504, Box, filed Sep. 7, 2012.

William M. Scott, U.S. Appl. No. 29/431,507, Box, filed Sep. 7, 2012.

William M. Scott, U.S. Appl. No. 13/673,246, Document Holding Device, filed Nov. 9, 2012.

William M. Scott, U.S. Appl. No. 29/436,876, Document Partition, filed Nov. 9, 2012.

William M. Scott, U.S. Appl. No. 29/436,882, Shaped Document Partition, filed Nov. 9, 2012.

International Search Report and Written Opinion for related International Application No. PCT/US2012/036980; mailed Dec. 3, 2012 (9 pages).

International Search Report and Written Opinion for related International Application No. PCT/US2012/037402; mailed Feb. 14, 2013 (15 pages).

International Search Report and Written Opinion for related International Application No. PCT/US2013/058651; mailed Jan. 14, 2014 (13 pages).

International Search Report and Written Opinion for related International Application No. PCT/US2013/058462; mailed Jan. 14, 2014 (11 pages).

International Search Report and Written Opinion for related International Application No. PCT/US2013/039953; mailed Jan. 16, 2014 (13 pages).

International Search Report and Written Opinion for related International Application No. PCT/US2013/069165; mailed Mar. 12, 2014 (12 pages).

(56) References Cited

OTHER PUBLICATIONS

William M. Scott, U.S. Appl. No. 13/441,434, filed Apr. 6, 2012, Pending.
William M. Scott, U.S. Appl. No. 13/448,349, filed Apr. 16, 2012, Abandoned.
William M. Scott, U.S. Appl. No. 29/500,759, filed Aug. 28, 2014, Pending.
William M. Scott, U.S. Appl. No. 29/445,333, filed Feb. 11, 2013, Abandoned.
William M. Scott, U.S. Appl. No. 29/438,590, filed Nov. 30, 2012, Pending.
William M. Scott, U.S. Appl. No. 14/075,324, filed Nov. 8, 2013, Pending.
William M. Scott, U.S. Appl. No. 13/896,859, filed May 17, 2013, Pending.
William M. Scott, U.S. Appl. No. 29/431,415, filed Sep. 7, 2012, Pending.
William M. Scott, U.S. Appl. No. 29/431,416, filed Sep. 7, 2012, Pending.
William M. Scott, U.S. Appl. No. 29/431,417, filed Sep. 7, 2012, Pending.
William M. Scott, U.S. Appl. No. 13/606,059, filed Sep. 7, 2012, Pending.
William M. Scott, U.S. Appl. No. 29/431,504, filed Sep. 7, 2012, Pending.
William M. Scott, U.S. Appl. No. 29/431,507, filed Sep. 7, 2012, Pending.
William M. Scott, U.S. Appl. No. 13/673,246, filed Nov. 9, 2012, Pending.
William M. Scott, U.S. Appl. No. 29/500,766, filed Aug. 28, 2014, Pending.

* cited by examiner

SHIPPING CONTAINER WITH GRIPS AND LOCKING PORTS

FIELD OF THE INVENTION

The invention pertains to containers and lids thereto having a removable or hinged lid, and a means for securing the lid closed onto the container.

BACKGROUND OF THE INVENTION

Individuals and businesses across many industries use containers to ship and store documents, materials, personal items, memorabilia, and the like. A common container for such use is a box having a lid for shipping elongated objects, including golf clubs and golf bags, carpet rolls and fishing poles. Such box is typically made of a corrugated paperboard or cardboard, and has elongated rectangular, planar sides and folded top and bottom panels.

In recent years, the popularity of golf has increased tremendously. This increase in popularity of golf can be seen by the rise in sales of golf equipment, such as golf clubs and golf bags, an increase in waiting times to "tee off" at local area golf courses, and an increase in the number of vacation-, conference-, and work-related destinations the feature golf. It is common to see golfers taking vacations and traveling long distances in order to play golf on golf courses all over the world. However, instead of renting golf equipment, such as golf clubs and golf bags, many golfers prefer using their own golf equipment when playing on these far-away golf courses.

In order for golfers to use their own equipment when playing on these far away golf courses, they must pack the golf equipment in a secure manner so as to avoid damaging or losing such equipment. This may consist of simply packing their golf equipment in the golf bag itself, and placing a cover over the opening of the golf bag, or buying specialty containers designed specifically for storing golf equipment during travel. However, it is a common occurrence for golf clubs and other equipment to be damaged or lost during travel using the currently known specialty equipment designed for storing golf equipment during travel. This is especially true when the golf equipment is stored with luggage or other heavy objects in a luggage compartment of an airplane during air flights to these various golf courses.

Lost and damaged golf equipment, of course, has led to an increased demand for golf storage cases which both protect golf equipment while ensuring that the golf equipment will not be lost during travel. Many of these currently designed golf cases are shells constructed from metal or rigid plastic and are shaped to accommodate a golf bag with golf clubs stored therein. Generally, these types of cases comprise two mating shells hinged together along a side so that the case may be opened to receive the golf equipment therein. Some examples of these types of cases are shown in U.S. Design Pat. Nos. 252,774, 282,303, 350,026, and 394,950.

Still other currently designed cases are tubular in design and incorporate a cap or the like through which a golf bag with golf clubs can be inserted or removed from the case. An example of this type of case container is U.S. Design Pat. No. 312,531. While these case containers can store golf clubs and golf bags and prevent loss thereof, they are generally expensive, very heavy and cumbersome.

The popularity of golf has also increased the sale of golf equipment. Accordingly, an increased number of golf bags and golf clubs or a combination thereof are now being transported via mail or other shipping methods. In these instances, there is a potential for individual golf clubs to be separated from the remaining golf clubs, or even to be lost or damaged during transport to their destination.

Various types of cardboard shipping and display boxes have been developed for shipping golf clubs. Examples of these various types of shipping and display boxes are shown in U.S. Pat. Nos. 5,495,983, 2,645,353, 2,604,255, 2,289,619, and 1,974,674, the disclosures of which are incorporated by reference in their entireties. However, the above examples of golf club shipping boxes do not make provisions for the inclusion of a golf bag, but rather only the golf clubs.

U.S. Pat. No. 6,123,254, the disclosure of which is incorporated by reference, discloses a three-sided corrugated box made from a single piece of corrugated.

There is thus a current need for an inexpensive golf equipment container that provides protection for a golf bag and golf clubs against damage during travel or transport. There is also a need for an inexpensive golf equipment container which prevents the loss or separation of the golf bag and clubs during travel or transport. There is still a further need for a golf equipment container that can accommodate both the golf bag and golf clubs, and other equipment.

SUMMARY OF THE INVENTION

An aspect of the present invention is a shipping container for protecting a golf bag with golf clubs stored therein during travel or shipping.

Another aspect of the present invention is a golf bag shipping container for preventing the loss or separation of golf clubs during travel or shipping.

Still another aspect of the present invention is a golf bag shipping container that is constructed from a single corrugated cardboard or similar material blank.

Yet another aspect of the present invention is a golf bag shipping container that is convenient to form and use, and convenient to lift and carry by hand.

Another aspect of the present invention is a golf bag shipping container including a lid or other removable portion that can be selectively closed and secured onto the container.

Still another aspect of the present invention is a golf bag shipping container including a lid or other removable portion that can be selectively closed, secured and locked onto the container, to minimize, prevent or deter other persons from accessing and tampering with the contents of the closed and locked container.

Another aspect of the present invention is a golf bag shipping container including a lid in a closed position and a locked condition on the box that indicates tampering or breach of the securing means.

Another aspect of the invention is the container body having a second, lower opening, and a second or lower lid that is configured to fit over and attach to the second, lower opening at the second end of the container, covering a bottom portion of the container body.

In another aspect of the invention, the lid or other removable portion can be a distinct and separate element from the multiple-walled body, which can be placed over the opening of the box and removed from the box. Alternatively, a side edge of the lid can be integral with or secured to an upper portion of at least one of the sidewalls of the container, to provide the shipping container with a hinged, lockable lid.

At least one, and typically two or more, of the sidewalls of the container body has at least one, and typically two or more, handle opening(s) disposed along the length of the sidewall, for lifting handling and carrying the shipping container.

Another aspect of the invention is an ergonomic grip opening, having an ergonomically-shaped, concavely-profiled upper portion, which substantially aligns to the natural curvature of bottom creases of the finger, for positioning in the lid and in the container body for improved lifting and handling of the container.

The present invention provides a container comprising a multiple-walled body and at least one lid configured for attachment to an open end of the multiple-walled body. The multiple-walled body comprises at least three sidewalls, including four sidewalls in a rectangular or square arrangement, joined to adjacent sidewalls along common side edges thereof. The first end edges of the sidewalls define a first opening at a first end of the body. A lid is configured to fit over and attach to the first opening at the first end of the container, covering a top portion of the container body. The lid and the top portion of the container body including locking ports therethrough, typically in registration, to enable a locking means to secure the lid to the container body.

The present invention also provides an elongated container comprising a container body and a lid, the container body comprising: a plurality of sidewalls, the plurality of sidewalls being joined to adjacent sidewalls along a common edge and having a top edge that defines a top opening, wherein at least one sidewall comprises a top portion having a grip opening and a locking port; and a lid comprising a top panel that covers the top opening of the container body, and a plurality of side panels that extend from the top panel and cover the top portions of the sidewalls, wherein at least one side panel has a grip opening that registers with the grip opening in the top portion of the at least one sidewall to form a through-lid grip opening, and wherein the at least one side panel has a locking port that registers with the locking port in the top portion of the at least one sidewall to form a through-lid locking port.

The present invention also provides a method for inserting and securing an elongated article in a shipping container, comprising the steps of: a. providing an elongated container body comprising: a plurality of sidewalls, the plurality of sidewalls being joined to adjacent sidewalls along a common edge and having a top edge that defines a top opening, wherein at least one sidewall comprises a top portion having a locking port; b. inserting the elongated article into the container body through the top opening; c. providing a lid comprising a top panel that covers the top opening of the container body, and a plurality of side panels that extend from the top panel and cover the top portions of the sidewalls, the at least one side panel has a locking port that registers with the locking port in the top portion of the at least one sidewall to form a through-lid locking port; d. placing the lid over the top opening of the container body to register the locking port in the lid with the locking port in the container body to form a through-lid locking port; and e. securing the lid to the container body with a locking means inserted through the through-lid locking port.

BRIEF DESCRIPTION OF THE DRAWINGS

While the specification concludes with claims particularly pointing out and distinctly claiming the invention, it is believed that the embodiments set forth herein will be better understood from the following description in conjunction with the accompanying figures, in which like reference numerals identify like elements and in which:

DETAILED DESCRIPTION OF THE INVENTION

Figure 1:
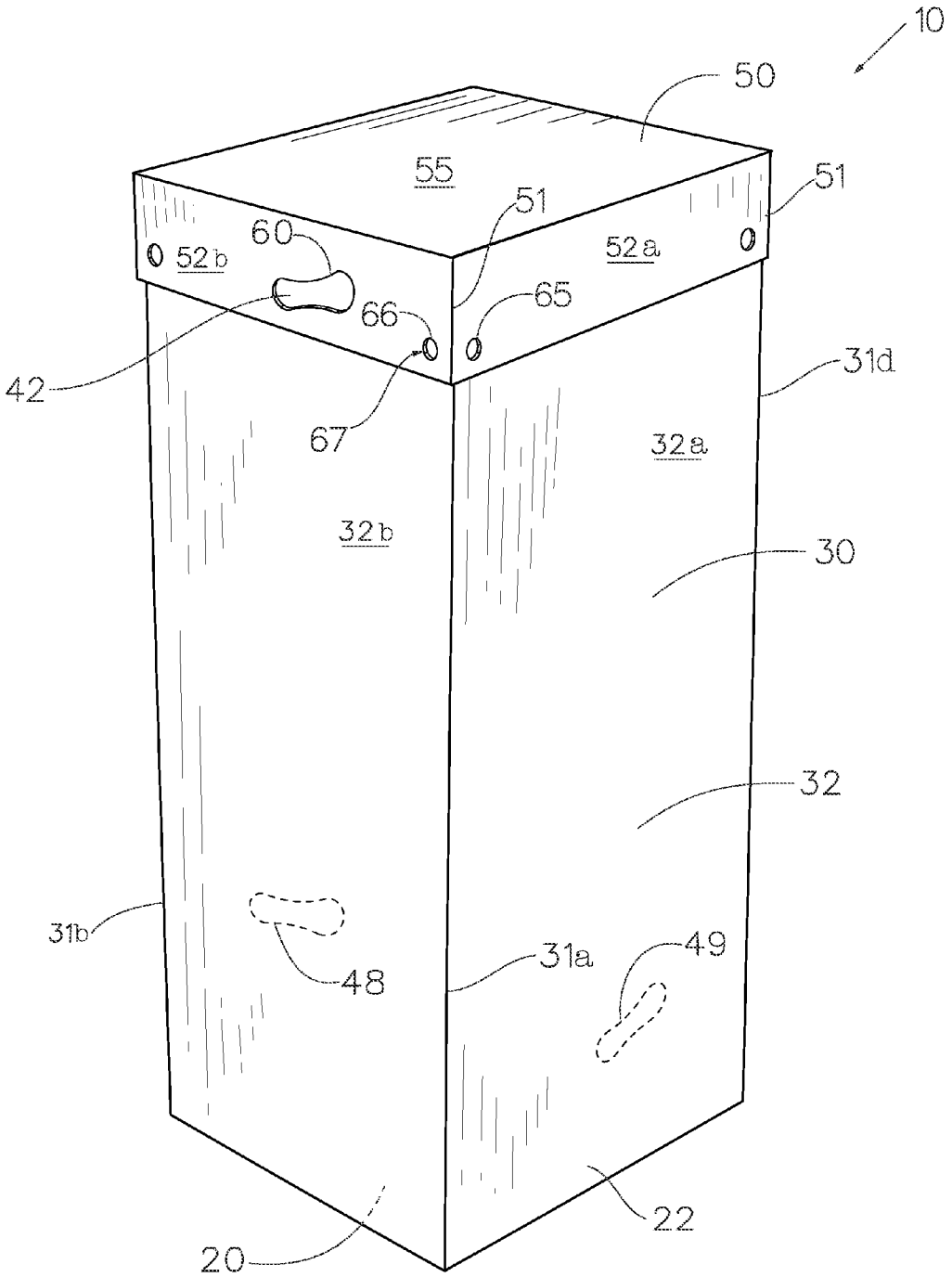
FIG. 1 shows a perspective view of a shipping container including a container body and a lid, and having a through-lid grip opening and through-lid locking ports.
Figure 2:
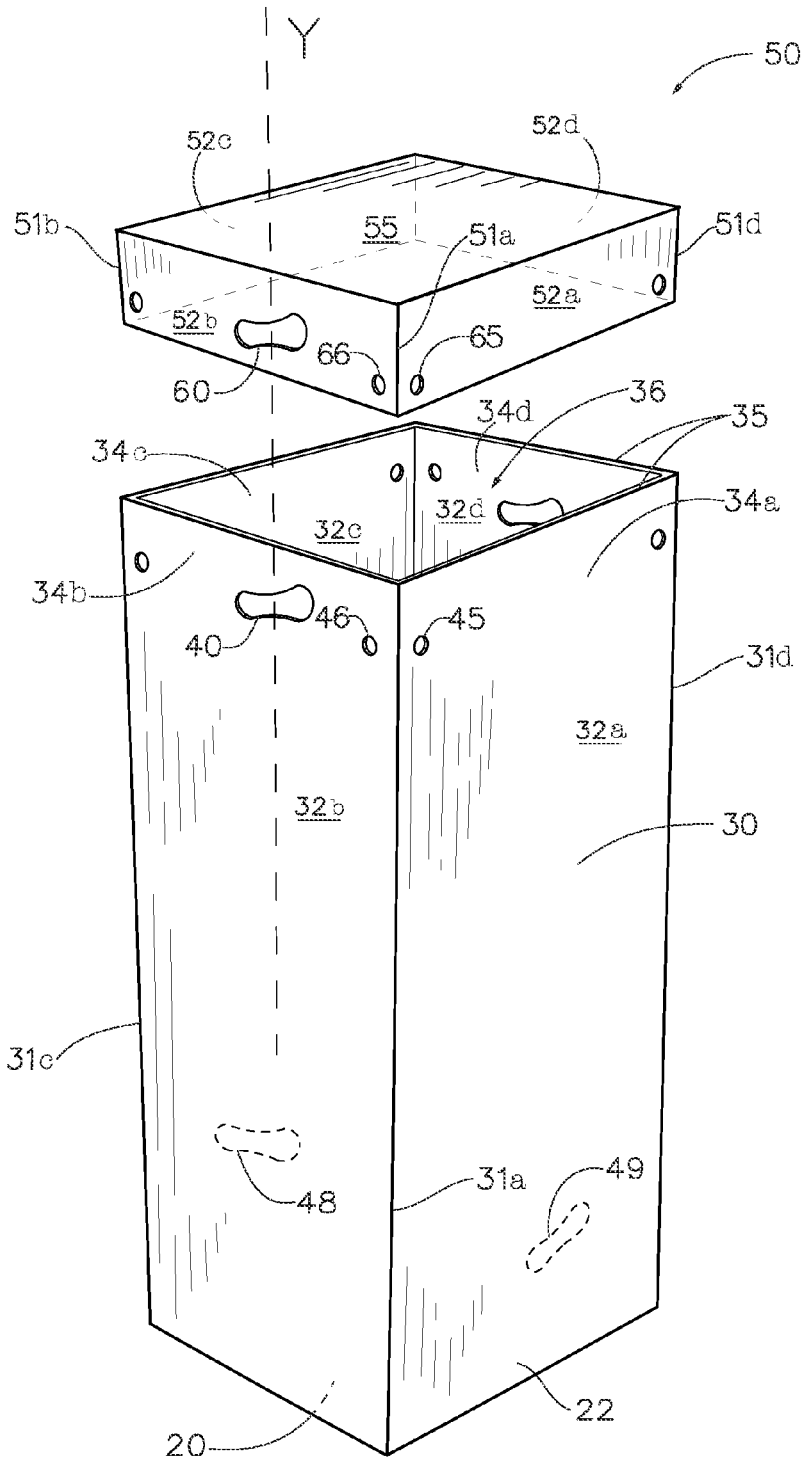
FIG. 2 shows an exploded view of FIG. 1 showing the lid removed from the top opening of the container body.

FIGS. 1 and 2 show an embodiment of a shipping container 10 that includes an elongated container body 30 that has a plurality of sidewalls 32, illustrated as rectangular sidewalls 32*a*,32*b*,32*c*,32*d* joined along common side edges 31 to adjacent sidewalls (for example, common side edges 31*a*,31*b*, 31*c*), wherein the top edges 35 of the plurality of sidewalls 32 define a top opening 36. Each sidewall 32 has a vertical center plane Y through the lateral center point of the sidewall. Each sidewall 32 also includes a top portion 34, illustrated as top portions 34*a*,34*b*,34*c* and 34*d*. The container body 30 also has a closed bottom panel 20.

The container body 30 has a grip opening 40 formed within the top portion 34 of at least one of the sidewalls 32, including in the top portions 34 of opposed sidewalls 32, for example in the top portions 34*b* and 34*d* of opposed sidewalls 32*b* and 32*d*. The container body 30 also has one or more locking ports, illustrated as a plurality of locking ports that include locking ports 45 and 46 formed within the top portion 34 of a pair of adjacent sidewalls 32 proximate the common side edge 31, for example, in the top portions 34*a* and 34*b* of adjacent sidewalls 32*a* and 32*b* proximate common side edge 31*a*.

The shipping container 10 also includes a lid 50 for covering the top opening 36 of the container body 30. The lid 50 includes a top panel 55 and a plurality of side panels 52 that extend downward from the top panel 55 and are joined along common side edges 51 to adjacent side panels 52 to cover the outer surface of the top portions 34 of the four contiguous sidewalls 32 of the container body 30. Each side panel 52 of the lid has the vertical center plane Y through the lateral center point of the side panel. In the illustrated lid, adjacent side panels 52*a* and 52*b* are joined along common panel edge 51*a*, while side panel 52*b* shares common panel edge 51*b* with adjacent side panel 52*c*, and side panel 52*a* shares common panel edge 51*d* with adjacent side panel 52*d*.

The lid 50 has a grip opening 60 in at least one of the side panels 52, including in opposed side panels 52, for example, in opposed side panels 52*b* and 52*d*. The grip opening 60 in the side panel 52*b* of the lid is sized and positioned to register with the grip opening 40 in the top portion 34*b* of the sidewall 32*b* of the container body when the lid 50 is disposed over the top opening 36, to form a through-lid grip opening 42 (FIG. 1).

The lid 50 also has one or more locking ports in at least one of the side panels, illustrated as a plurality of locking ports that include locking ports 65 and 66 formed within a pair of adjacent side panels 52 proximate a common panel edge 51, including in adjacent side panels 52*a* and 52*b* proximate common panel edge 51*a*. The locking ports 65 and 66 of the lid 50 are sized and positioned in the adjacent side panels 52*a* and 52*b* to register with the locking ports 45 and 46 in the top portions 34*a* and 34*b* of the sidewalls 32*a* and 32*b* of the container body 30 when the lid 50 is disposed over the top opening 36, to form a through-lid locking port 67 (FIG. 1).

The proximity and registry of the pair of lid locking ports 65,66 and the pair of container locking ports 45,46, adjacent the common edges 31,51 and in horizontal alignment, facilitates a locking means to be inserted through the through-lid locking port 67 (for example, threaded through locking ports 46,66,65 and 45), and locked or sealed, thereby locking the lid 50 to the container body 30. As illustrated in FIG. 2, the shipping container can have two or more additional through-lid locking ports that are registered and secured with a locking means, wherein each through-lid locking port consists of pairs of locking ports in both the lid and container body, adjacent to one or more of the remaining common edges in the container body and lid.

The periphery of the area of the locking port opening 51 can have a shape that includes circular, oval, elliptical, and polygonal, and wherein a major axis of an oval, elliptical or polygonal shape can be oriented in any direction, including horizontal, vertical, or any angle therebetween. A locking port typically has a diameter or minor axis dimension of at least about a digit width, to permit a user to insert a finger into the locking port to guide the leading end of the locking device through both locking ports.

Alternatively, though not illustrated, a pair of locking ports can be formed into the top panel 55 and an upper part of the side panel 52 of the lid 50, and a locking port can be formed into an upper portion 34 of the sidewall 32 of the container box 30, to register with the lid lock port in the side panel. Notwithstanding, penetration of the top panel 55 of the lid 30 should be avoided to prevent complications with snagging of the lock features when containers are stacked one on another, or when other objects are stacked or moved thereon.

In the illustrated embodiment, a lid grip opening 60 is formed into at least one of the side panels 52 of the lid, typically at or near the lateral center point, and a container grip opening 40 is formed into top portion 34 of at least one sidewalls 32 to register with the lid grip opening 60 when the lid 50 is disposed over the top opening 36, to form the through-lid grip opening 42 (FIG. 1). The through-lid grip opening 42 provides a grasping position on the container 10 for handled or lifted the container 10 as a unit. As illustrated in FIG. 2, another pair of grip openings can be formed into the opposite side panel 52*d* of the lid and the opposite sidewall 32*d* of the container body, to provide a second, opposite and geometrically symmetrical through-lid grip opening.

Figure 9:
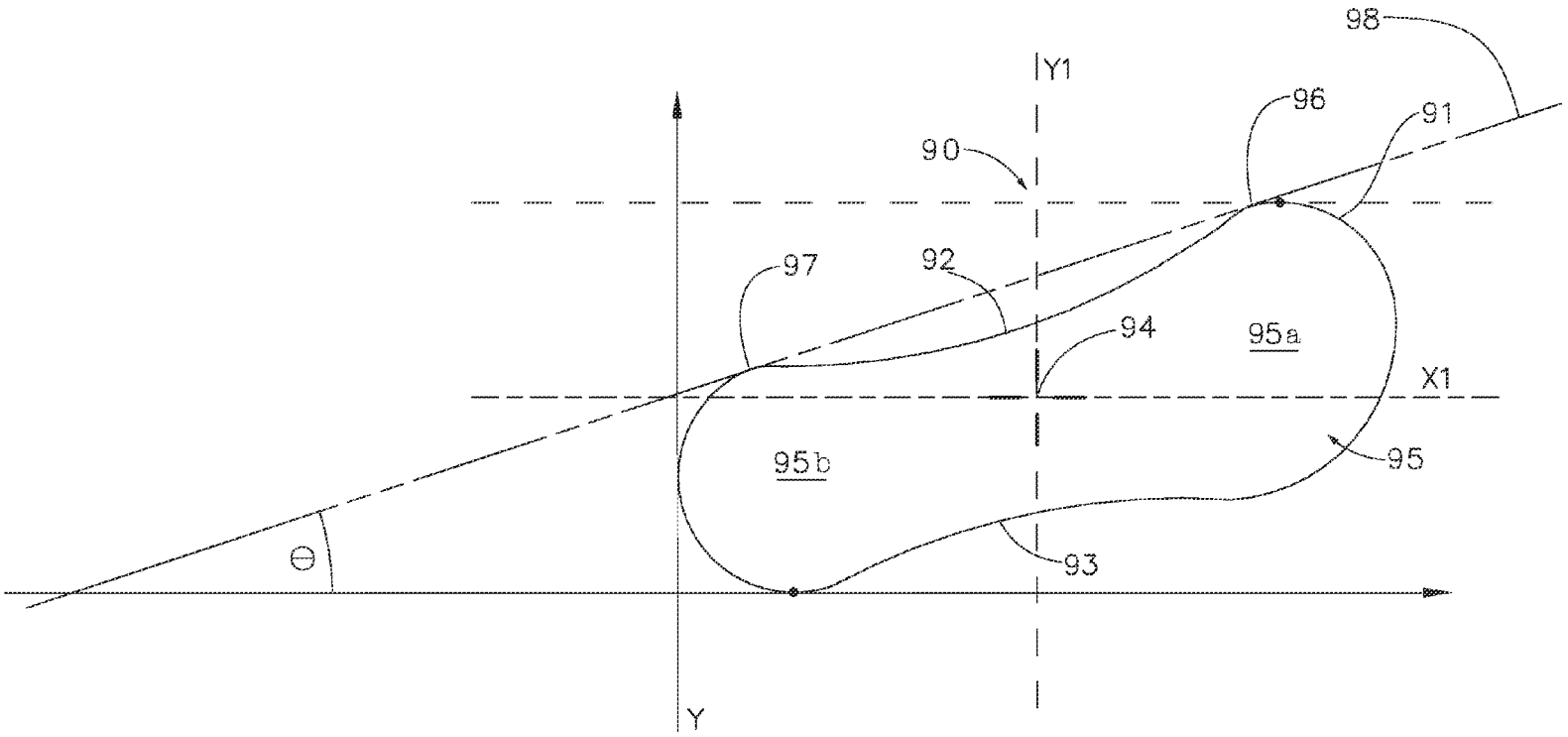
FIG. 9 shows a plan view of a grip opening.

In a preferred embodiment illustrated in FIG. 9, the periphery of the locking grip opening has an ergonomically-shaped, concavely-profiled upper portion, which substantially aligns to the natural curvature of bottom creases of the fingers. Alternatively, aspects of the invention can be practiced with an upper peripheral portion that is linear or curvilinear. Ergonomically-shaped grip openings are described in U.S. Provisional Patent Application 61/649,231, filed May 18, 2012, the disclosure of which is incorporated by reference in its entirety.

As illustrated, grip openings 48 and 49 can optionally be formed within one or more of the sidewalls 32 of the container body 30. The optional grip openings 48 and 49 can be positioned anywhere along the length (height) of the sidewall(s), in a portion other than the top portion, including but not limited to near the bottom 22 of the container body and in the middle of the container body. The optional grips 48 and 49 can also be disposed along the center plane Y or near the side edges of the sidewalls. These optional grip openings assist a person in grasping, lifting, and carrying the container, particularly when weighted with a heavy article, such as a full set of golf clubs and a golf bag.

The lateral and longitudinal dimensions of the sidewalls 32 of the container body are selected to define a confined space within the container body that can accommodate any elongated article, including but not limited to, a golf bag with a set of golf clubs. Typically the lateral (or maximum width) dimension is at least about 1 inch, including at least about 2 inches, at least about 4 inches, at least about 8 inches, and at least about 6 inches, and up to about 24 inches, including up to about 20 inches, up to about 12 inches, and up to about 6 inches. Typically the longitudinal (or maximum length) dimension is at least about at least about 6 inches, including at least about 12 inches, at least about 24 inches, and at least about 36 inches, and up to about 120 inches, including up to about 96 inches, up to about 72 inches, and up to about 54 inches.

The container body can have a longitudinal:lateral dimensions ratio of at least 2:1, including at least 3:1, at least 4:1, at least 5:1, and up to about 10:1, and up to about 20:1, including up to about 10:1, up to about 5:1, up to about 4:1, and up to about 3:1.

The bottom panel 20 of the container body 30 can be formed from corrugated panels extending from the bottom edge 22 of each sidewall 32, which are then folded and secured by well-known means, including using tabs and slots in the bottom panels, or by taping closed the bottom panels.

Figure 3:
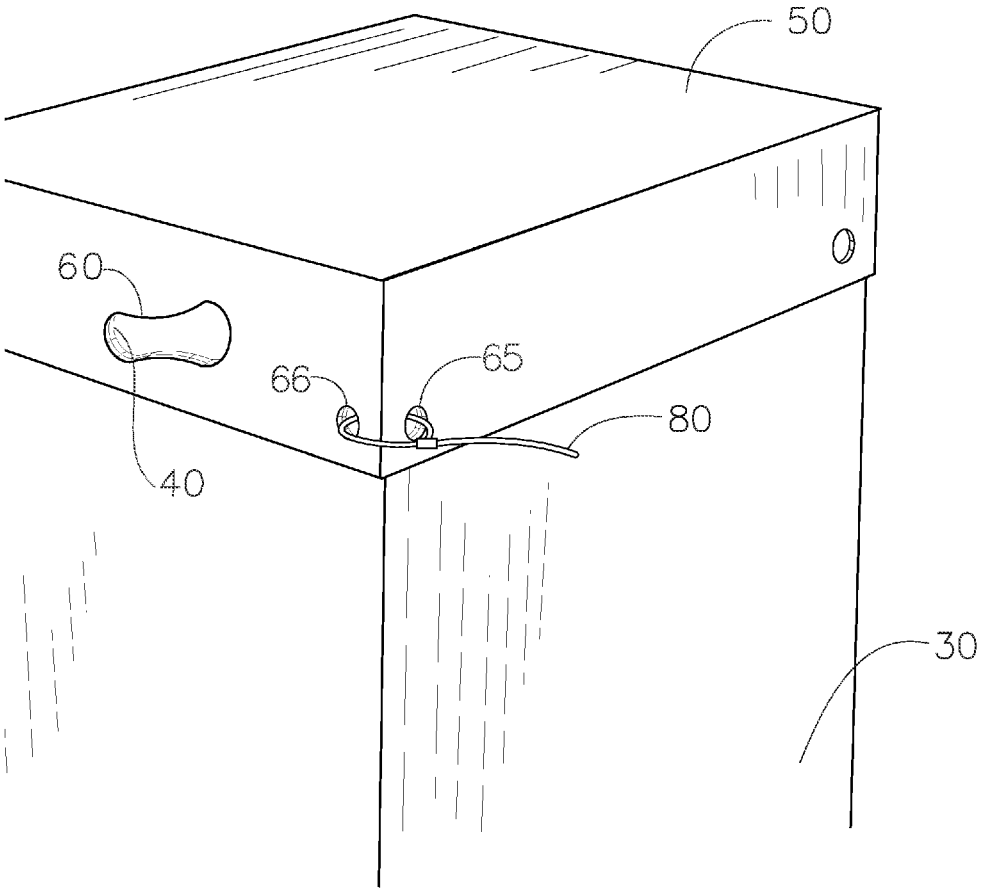
FIG. 3 shows a cable tie installed through one of the through-lid locking ports of the shipping container of FIG. 1.

When used as a shipping container for elongated articles, for example, golf clubs, the user forms the container body by forming and closing the bottom, and inserts the golf bag and/or set of clubs into the space within the container body. The lid 50 is oriented to ensure alignment of the lid grip opening 60 vertically with the container grip opening 40, and fitted over the top opening 36 so that the side panels 52 of the lid 50 overlap the top portions 34 of sidewalls 32 of the container body 30. A locking means is threaded through the registered pairs of locking ports 65,66 in the lid 50 and locking ports 45,46 in container body 30. The locking means can include a strap having a means for securing or locking one end of the strap to a portion of the other end, and can include a strap seal or a cable tie. FIG. 3 illustrates the locking means as a cable tie 80. Strap seals and cable ties are well known and used for numerous securement and tying needs. A nylon cable tie has an elongated strap member having a distal end, and a proximal end with an integrated open case having a ratchet that can engage a rack of teeth along the length of the strap member. Pulling the distal end of the cable tie through the case and past the ratchet, prevents the strap member from being pulled back out of the case. Once secured to the shipping container, the loop of the strap member typically has to be cut to remove the cable tie and unlock the lid from the container body. In use, the distal end is inserted into and through the through-lid locking port 67, and inserted and pulled through the ratchet of the open case until the loop of the cable tie encircles the portion of corrugated materials between the pairs of locking ports.

In an alternative embodiment, the lid can be constructed integrally with one of the sidewalls of the container body. The integral construction can comprise a permanent or semi-permanent attachment of a side panel of the lid to the top portion of the sidewall, such as by adhesive attachment, or can comprise forming both the lid and the sidewall from the same sheet of corrugated material. The integration of the lid with the container body provides a hinged connection so that the lid can be folded back from and over the opening 36 of the container body.

Figure 4:
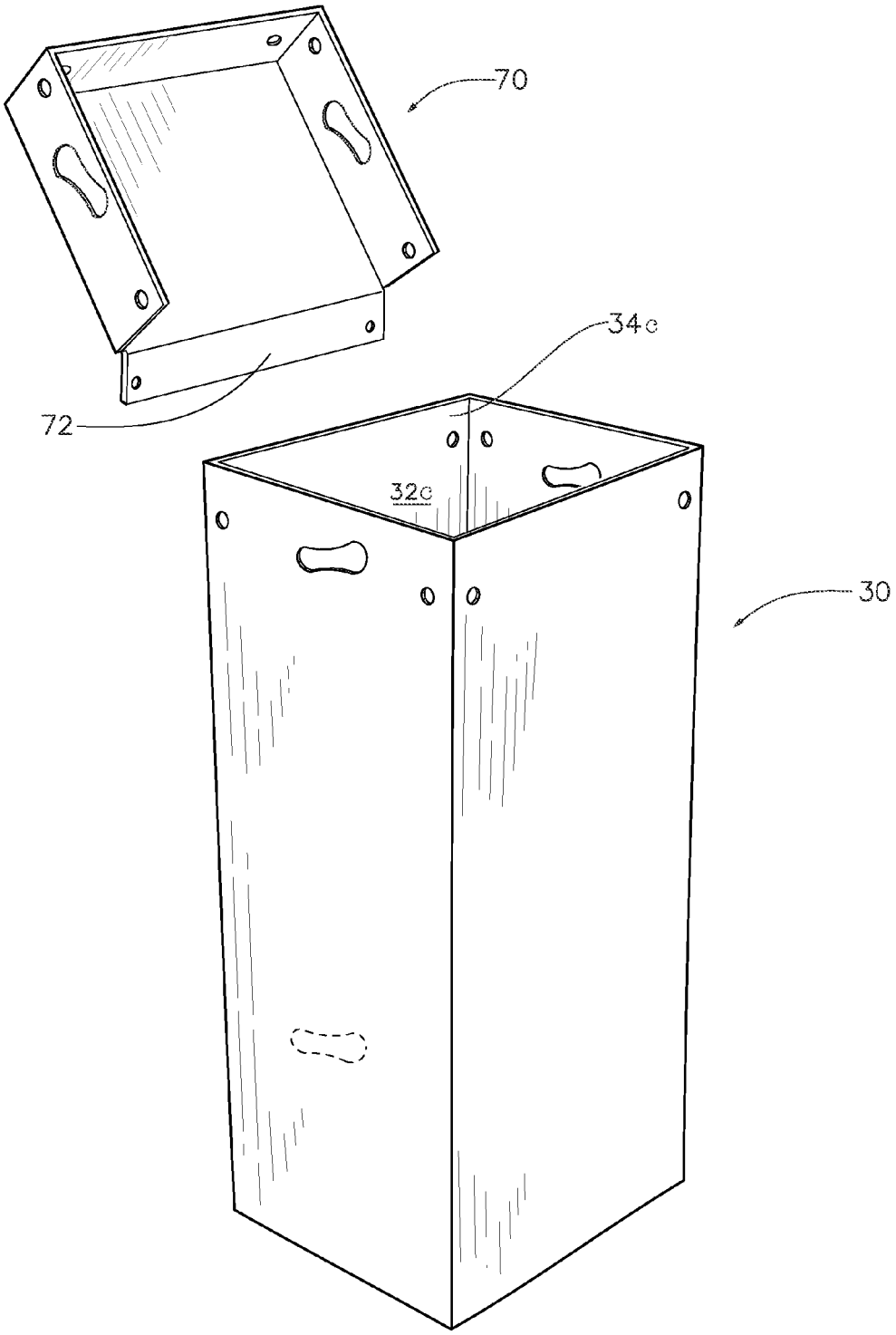
FIG. 4 shows an exploded perspective view of another embodiment of a shipping container including a container body with an attachable hinge lid, and having grip openings and locking ports in the container body and lid.
Figure 5:
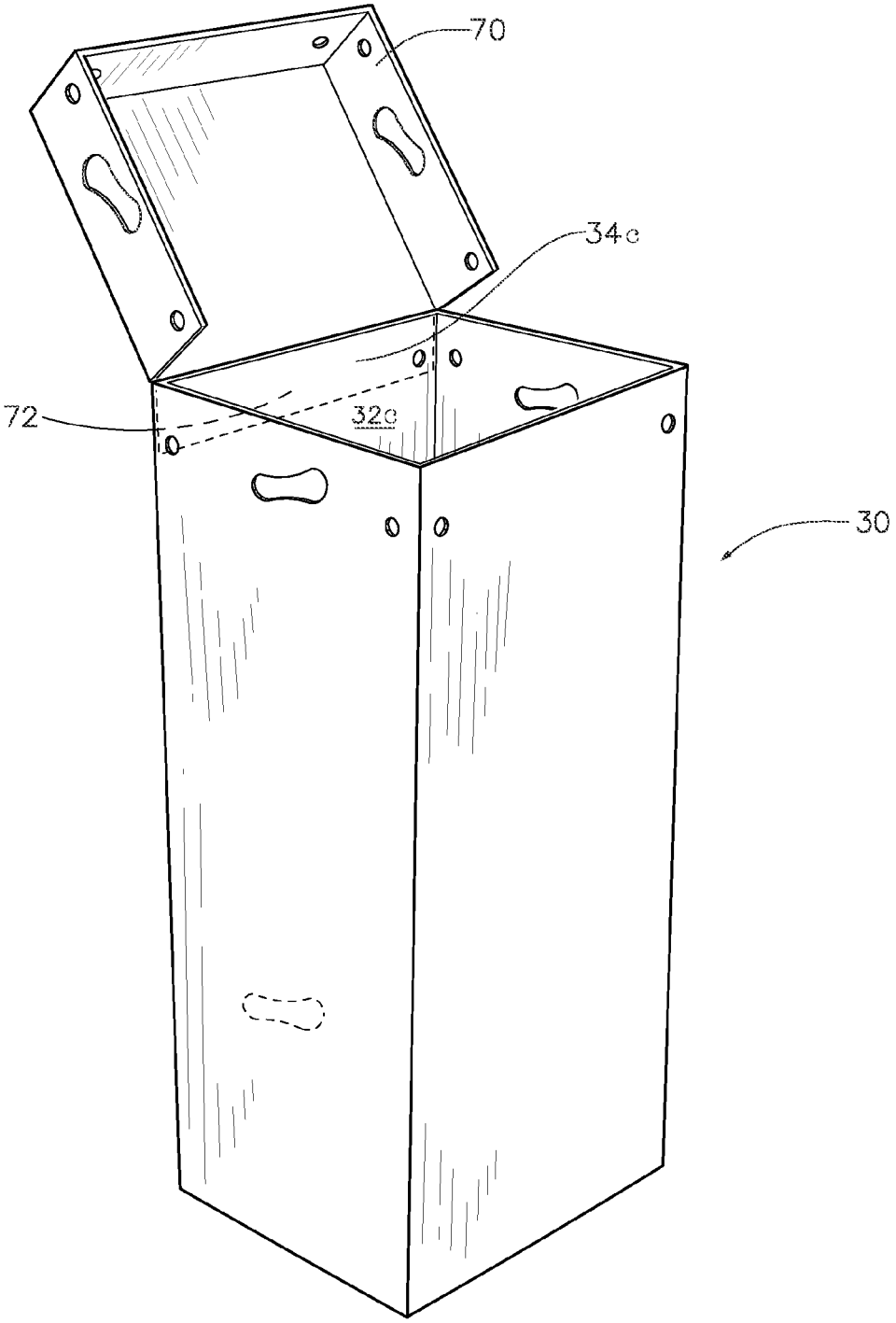
FIG. 5 shows the shipping container of FIG. 4 with the hinge lid attached to the container body.

FIGS. 4 and 5 illustrate an integral lid 70 having an extending side panel 72 with an inner surface that is attached, typically adhesively, to the outer surface of the top portion 34*c* of sidewall 32*c*. The folding over of the integral lid 70 onto the container body would appear substantially as illustrated in FIG. 1.

Figure 6:
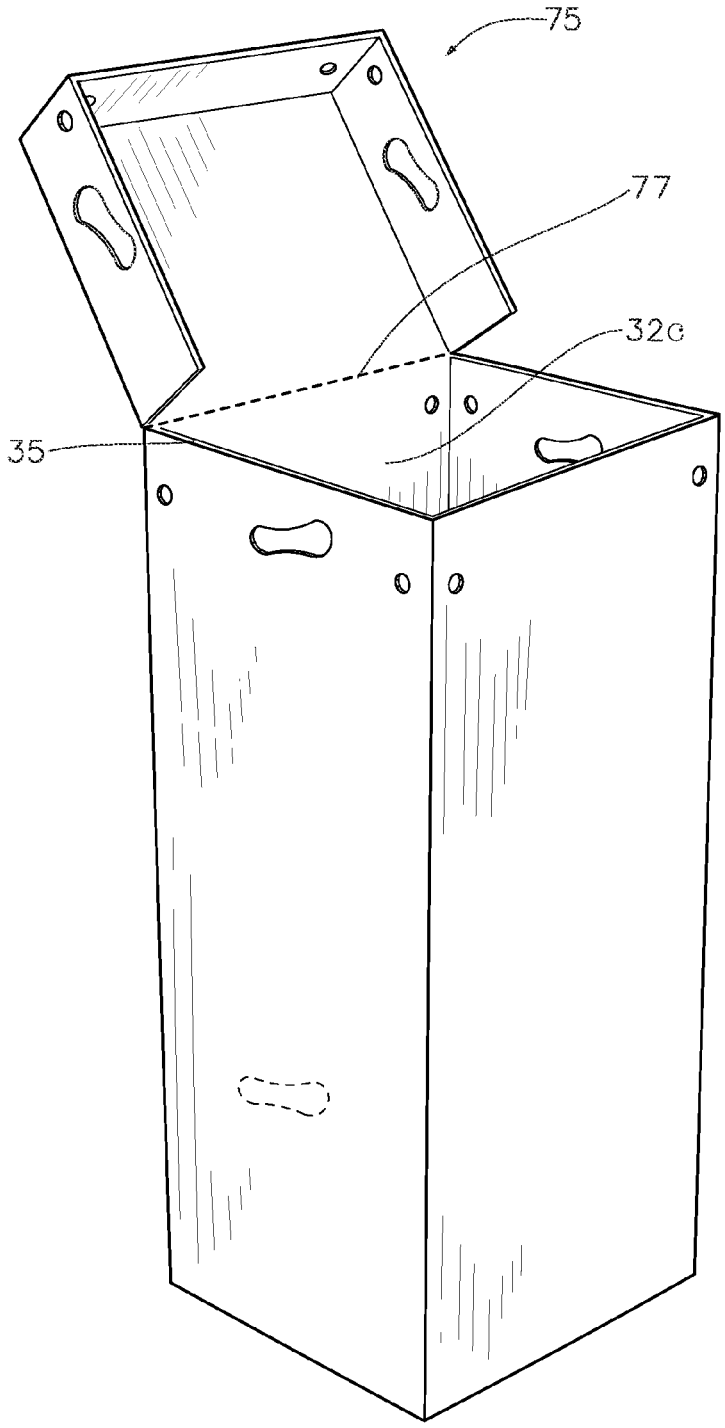
FIG. 6 shows a perspective view of an alternative embodiment of a shipping container including the container body with an integral lid, and having grip openings and locking ports in the container body and lid.

FIG. 6 illustrates an alternative embodiment of an integral lid 75 formed from the same sheet of corrugated material as the sidewall 32*b*, and is hinged along a fold line 77 to the sidewall 32*b* along the edge 35. Likewise, the folding over of the integral lid 75 onto the container body would appear substantially as illustrated in FIG. 1.

In an embodiment wherein the lid 75 is hinged to the top portion 34*c* of sidewall 32*c*, two pairs of through-lid locking ports are formed by forming locking port openings into each of the lid and container body, including through the side panel 52*a* and the sidewall 32*a* opposite the hinged lid. A first pair of lid locking ports 65,66 are formed into adjacent side panels 52*a*,52*b* near the common edge 51*a* shared by the two adjacent side panels 52*a*,52*b* of the lid, and a first pair of container locking ports 45,46 are formed into portions 34 of adjacent sidewalls 32*a*,32*b* near the common edge 31*a* shared by the two adjacent sidewalls 32*a*,32*b* of the container body. Similarly, a second pair of lid locking ports 65,66 are formed into adjacent side panels 52*a*,52*d* near the common edge 51*d* shared by the two adjacent side panels 52*a*,52*d* of the lid 50, and a second pair of container locking ports 45,46 are formed into portions 34 of adjacent sidewalls 32*a*,32*d* near the common edge 31*d* shared by the two adjacent sidewalls 32*a*,32*d* of the container body 30. When the hinged integral lid 75 is closed over the opening, the two pairs of through-lid locking ports can be secured with a locking means to lock the front portion of the lid 50 to the sidewall of the container body 30 that is positioned opposite the hinge connection 77.

Figure 7:
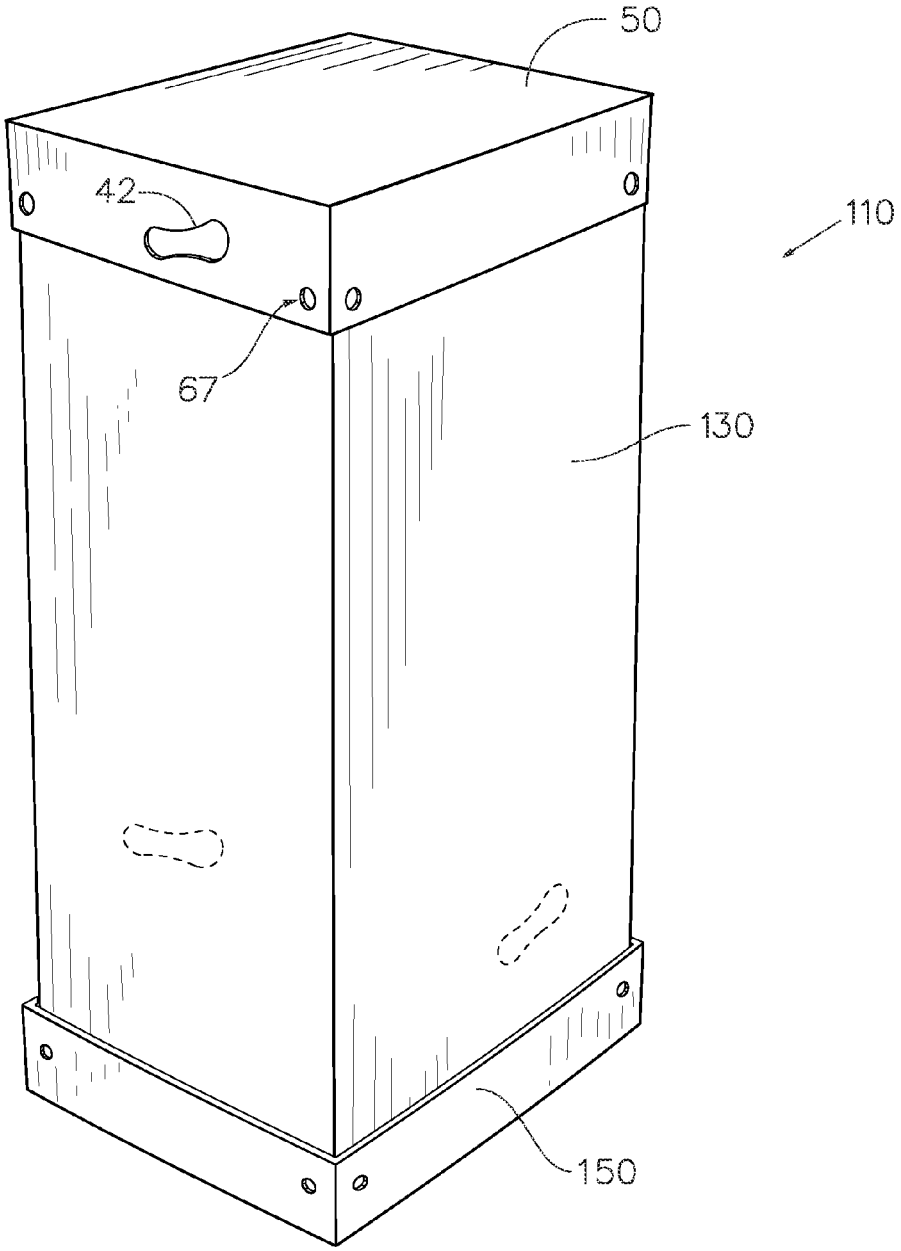
FIG. 7 shows a perspective view of another embodiment of a shipping container, including a container body having a top opening and a bottom opening, and a pair of lids covering the top and bottom openings of the container body.
Figure 8:
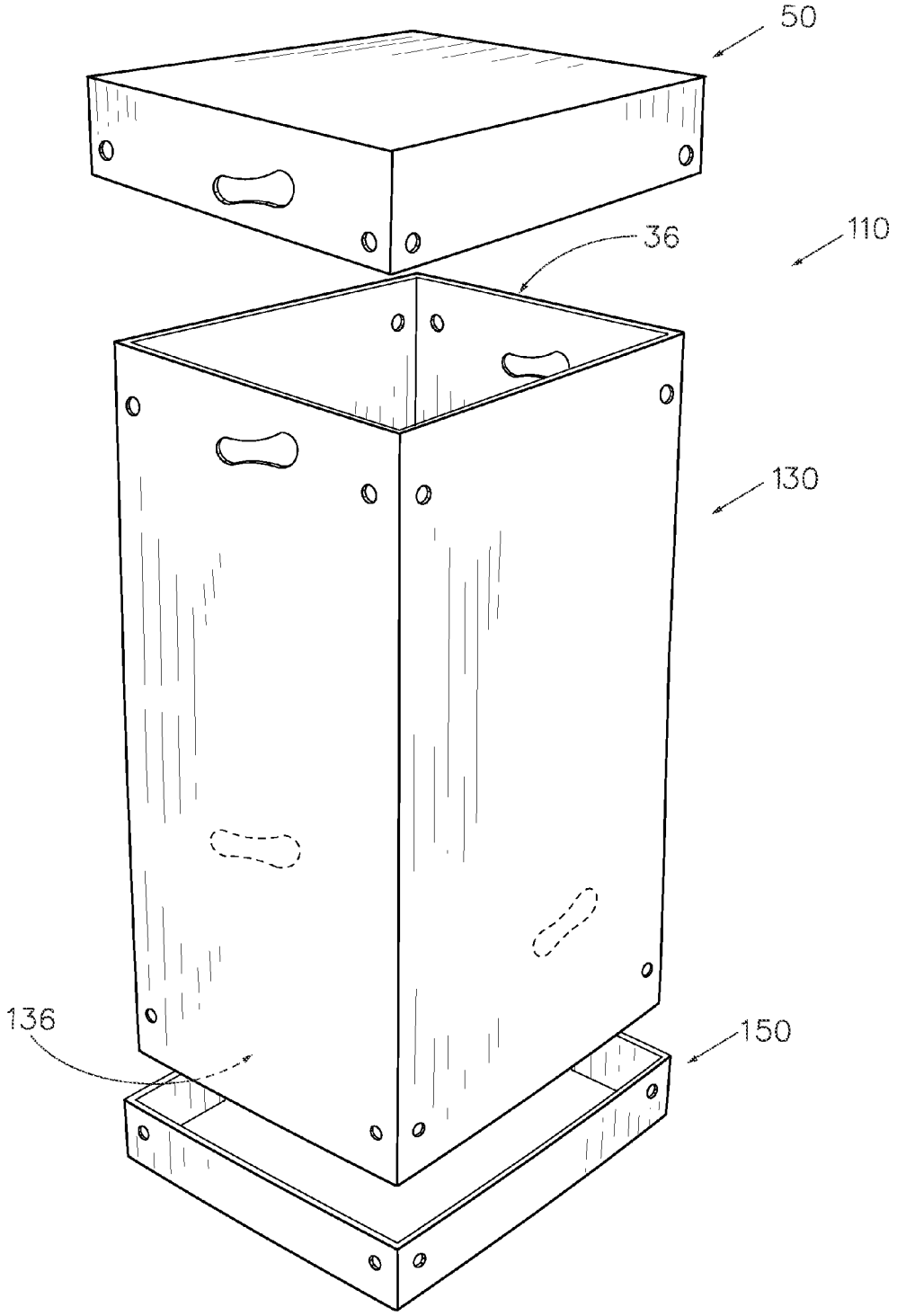
FIG. 8 shows an exploded view of FIG. 7 showing the lids removed from the top opening and bottom opening of the container body.

In an alternative embodiment of shipping container, a container 110 is shown in FIGS. 7 and 8 to include a container body 130 that includes a first or upper lid 50 for covering the top opening 36 of the container body 130, and a second or bottom lid 150 for covering a bottom opening 136 of the container body 130. The bottom lid 150 is constructed and functions substantially in the manner of the top lid 50, although including of a through-lid grip opening in the bottom lid 150, as illustrated in FIG. 8, is optional. It can be understood that the bottom lid can also be an integral lid, substantially as described herein above for integral lid embodiments 70 and 75, which can be provided locking ports and optional grip openings, as described herein above.

A grip opening in a sidewall of the container body or in the side panel of the lid is illustrated in FIG. 9. The illustrated grip opening 90 has a periphery 91 including an upper periphery 92 and a lower periphery 93, the periphery 91 defining a grip opening area having a geometric center 94, the geometric center 94 having a horizontal axis x1, typically parallel with the top surface of the lid, that divides the grip opening area 95 into an upper area 95*a* and a lower area 95*b*, and a vertical axis y.

In another aspect of the invention, the vertical axis y1 of the geometric center of the grip opening can be disposed along the vertical center plane Y through the sidewall of the container body and the side panel of the lid, thereby providing a normal or un-biased grip position, with about 50% of the box mass disposed forward or distal of the vertical-lateral center plane, and the remaining 50% of the box mass disposed nearer or proximal of the vertical-lateral center plane (called a 50/50 unbiased position). Alternatively, the grip openings 40 and 60 in the container body and lid can be disposed in a position biased away from the vertical center plane y through the sidewall. That is, the vertical axis y1 of the geometric center of the grip openings in the box and lid can be biased forward of the vertical-lateral center plane Y, toward an adjacent sidewall of the box, and the corresponding adjacent side panel in the lid. Typically, the biasing can be to a position at least 5% the distance from the vertical-lateral center plane to the forward sidewall, such as at least 10%, at least 15%, at least 20% (60/40 forward biased position), at least 25%, at least 30%, at least 35%, at least 40% (70/30 forward biased position), at least 45%, or at least 50% (75/25 forward biased position), and up to 90%, such as up to 85%, up to 80% (90/10 forward biased position), up to 75%, up to 70%, up to 65%, up to 60% (80/20 forward biased position), up to 55%, or up to 50% (75/25 forward biased position). Typically, a forward bias of between about 55/45 to about 65/35, such as 60/40, can be used. The forward-biased grip openings can cause the user's hands, when gripping the grips of the container, to extend more forwardly (that is, away from the body) as compared to, for example, a user's gripping of a container or box having grips are positioned in the 50/50 unbiased position.

In alternative embodiments of a grip opening, the upper periphery 92 and lower periphery 93 can have a shape that includes linear and curved, to provide a grip opening with a shape that can include rectangular, elliptical and oval.

A grip opening in a container body and a grip opening in a lid, shown in FIG. 9, has an upper periphery 91 that includes at least one inflection point, illustrated as an upper inflection point 96 (also referred to as a forward inflection point) and a lower inflection point 97 (also referred to as a rearward inflection point). The vertical difference between the inflection points defines a grip angle θ (theta) that is defined by a reference line 98 that passes through the upper inflection point 96 and the lower inflection point 97, relative to horizontal. The grip angle θ can be selected to help match the natural angle of the wrist when a user's arms are unburdened and at rest. By mimicking the wrists' natural angled position when at rest, the angled grips serve to cause much less stress to the hands, wrist, arms and upper and lower back when a user lifts, holds or moves with a weighted shipping container. The grip angle can broadly range from greater than about zero degrees to up to about ninety degrees from a horizontal axis, and is more typically at least 5 degrees, including at least 10 degrees, at least 15 degrees, at least 20 degrees, at least 25 degrees, and at least 30 degrees, and up to about 45 degrees, including up to about 40 degrees, up to about 35 degrees, up to about 30 degrees, up to about 25 degrees, and up to about 20 degrees, such as 15 degrees.

In another aspect of the invention, a pair of locking ports in the lid and the container body can be disposed proximate the grip openings in the lid and the container body, enabling insertion of the locking device through both the through-lid locking port and through-lid grip opening. Examples of through-lid locking ports and through-lid grip openings are described in U.S. Provisional Patent Application 61/649,231, filed May 18, 2011, the disclosure of which is incorporated by reference in its entirety.

Figure 10:
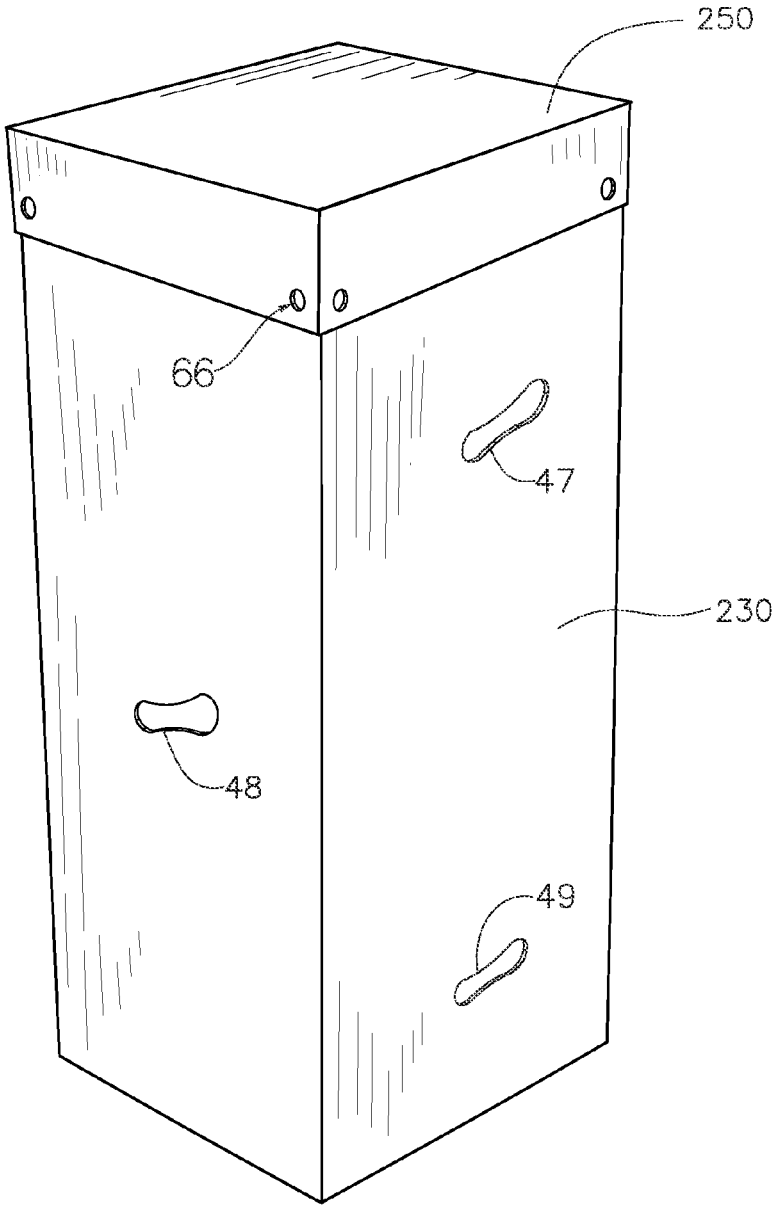
FIG. 10 shows a perspective view of yet another embodiment of a shipping container, including a container body having grip openings, and a lid having locking ports.
Figure 11:
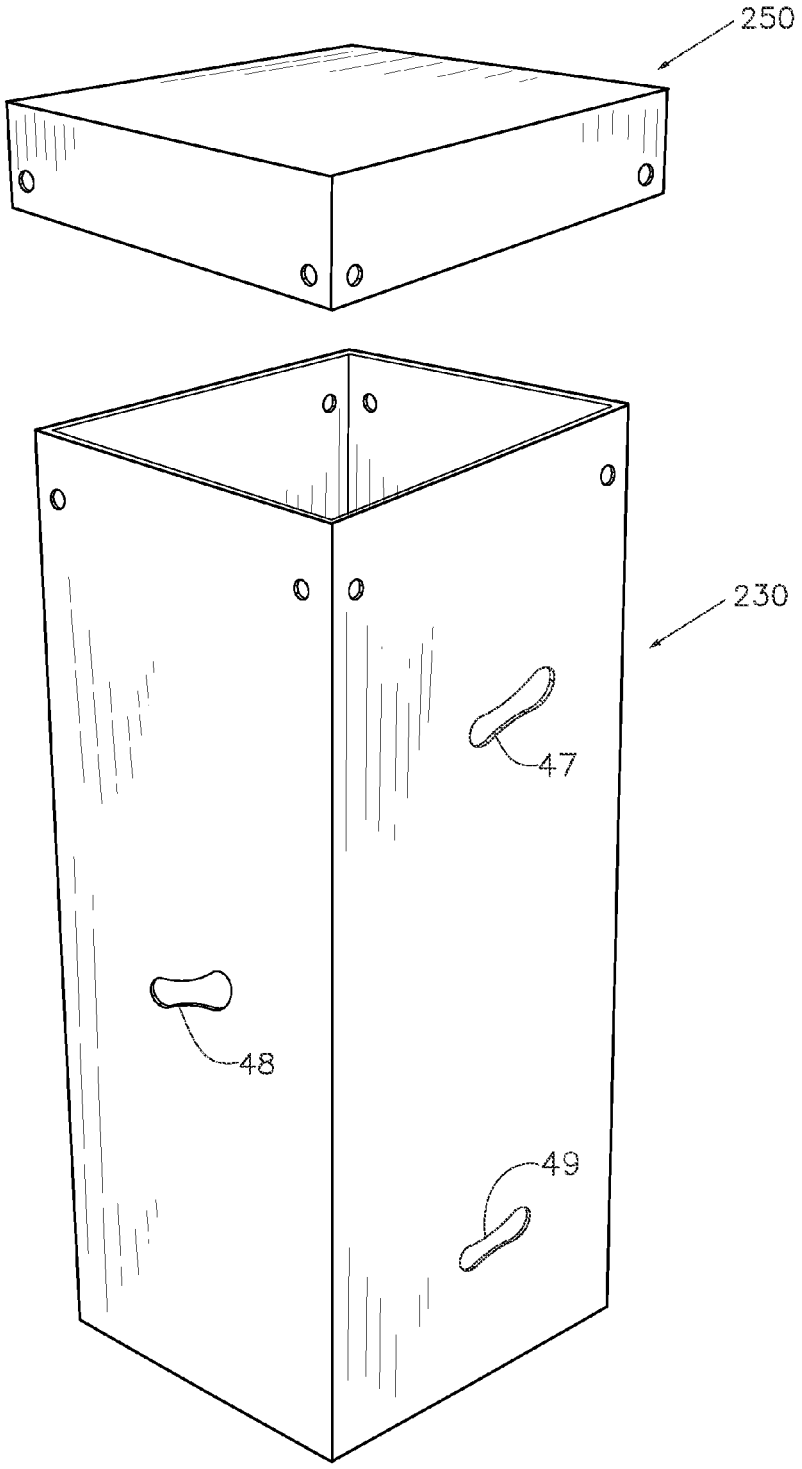
FIG. 11 shows an exploded view of FIG. 10 showing the lid removed from the top opening of the container body.

Another embodiment of the present invention is shown in FIGS. 10 and 11, wherein there are no grip openings through the side panels of the lid or through the top portion of the sidewalls of the container body. Grip openings 47, 48 and 49 illustrate that one or more grip openings can be the positioned in any one or more of the sidewalls 32, in any portion of the sidewall other than the top portion 34, including in a lower, middle and higher portion of the container body exposed below the attached lid.

The lid includes the locking ports as described herein above in prior embodiments. It is also understood that the container body can be formed with a second bottom opening, with a bottom lid provided with through-lid locking ports, as described herein above in a prior embodiment.

The container body and lid can be made from corrugate, including paperboard corrugate and plasticized corrugate, metal, plastic, and laminates and composites of any the foregoing and other material suitable for use for forming a container for use as such. Persons of skill in the art are well versed in suitable material types, and the embodiments herein are limited in their material usage.

The shipping container, including the container body and lid can be constructed from a single stamped or formed piece of material, by means well known in the art.

The invention also includes methods for inserting and securing an elongated article in a shipping container of the present invention. The article is inserted into the top opening of the container body, typically a closed bottom panel or with a bottom lid secured to the bottom opening. The lid is then placed over the opening so that the one or more locking ports in the lid register with the one or more locking ports in the top portion of the container body, to provide through-lid locking ports. A locking means, such as a cable tie or strap seal, is inserted through the through-lid locking port and closed, which secures the lid to the container body and prevents removal of the lid without cutting or otherwise tampering with the locking means, or tearing or damaging the lid and/or container body, which deters such tampering with or destroying of the locking means. It can be understood that the shipping container can include a plurality of the through-lid locking ports, typically in two or more corners of the lid. It is also understood that the container body and lid each can have one or more gripping ports to provide one or more through-lid grip openings.

This written description uses examples to disclose and illustrate the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An elongated container comprising a container body and a lid, the container body comprising: a plurality of sidewalls, the plurality of sidewalls being joined to adjacent sidewalls along a common edge and having a top edge that defines a top opening, wherein at least one sidewall comprises a top portion having a grip opening and a locking port; and the lid comprising a top panel that covers the top opening of the container body, and a plurality of side panels that extend from the top panel and cover the top portions of the sidewalls, wherein at least one side panel has a grip opening that registers with the grip opening in the top portion of the at least one sidewall to form a through-lid grip opening, and wherein the at least one side panel has a locking port that registers with the locking port in the top portion of the at least one sidewall to form a through-lid locking port, wherein the container body includes a pair of locking ports in the top portions of an adjacent pair of the sidewalls, adjacent the common edge between the adjacent pair of the sidewalls, and the lid includes a pair of locking ports in an adjacent pair of the side panels, adjacent a common edge between the adjacent pair of the side panels, wherein an edge of the top panel of the lid is hingedly attached to a top portion of one of the sidewalls to form an integral lid, wherein the lid includes two pairs of locking ports, including a first pair of locking ports in a first pair of adjacent side panels, proximate a common edge shared by the first pair of adjacent side panels, wherein the first pair of adjacent side panels include the side panel of the lid positioned opposite the hinge, and a second pair of locking ports in a second pair of adjacent side panels, proximate a common edge shared by the second pair of adjacent side panels, wherein the second pair of adjacent side panels also includes the side panel of the lid positioned opposite the hinge, wherein the container body includes two pairs of locking ports, including a first pair of locking ports in a first pair of adjacent sidewalls, proximate a common edge shared by the first pair of adjacent sidewalls, wherein the first pair of adjacent sidewalls include the sidewall of the container body positioned opposite the hinge, and a second pair of locking ports in a second pair of adjacent sidewalls, proximate a common edge shared by the second pair of adjacent sidewalls, wherein the second pair of adjacent sidewalls also includes the sidewall of the container body positioned opposite the hinge.

2. The elongated container according to claim 1, further including a locking means configured for secured insertion through the locking ports of the container body and the lid when registered.

3. The elongated container according to claim 1, wherein the top panel is structurally a continuous rectangular plane lacking voids.

4. The elongated container according to claim 1, wherein the container body includes a second pair of locking ports in an opposite, adjacent pair of the sidewalls, and the lid includes a second pair of locking ports in an opposite, adjacent pair of the side panels.

5. The elongated container according to claim 1, wherein the container body further includes a grip opening in at least one of the elongated sidewalls in a portion other than the top portion.

6. The elongated container according to claim 1, having a through-lid locking port through proximate both common edges of the side panel of the lid positioned opposite the hinge.

7. An elongated container comprising a container body and a lid, the container body comprising: a plurality of sidewalls, the plurality of sidewalls being joined to adjacent sidewalls along a common edge and having a top edge that defines a top opening, wherein at least one sidewall comprises a top portion having a locking port; and the lid comprising a top panel that covers the top opening of the container body, and a plurality of side panels that extend from the top panel and cover the top portions of the sidewalls, wherein the at least one side panel has a locking port that registers with the locking port in the top portion of the at least one sidewall to form a through-lid locking port, wherein the container body includes a pair of locking ports in the top portions of an adjacent pair of the sidewalls, adjacent the common edge between the adjacent pair of the sidewalls, and the lid includes a pair of locking ports in an adjacent pair of the side panels, adjacent a common edge between the adjacent pair of the side panels, wherein an edge of the top panel of the lid is hingedly attached to a top portion of one of the sidewalls to form an integral lid, wherein the lid includes two pairs of locking ports, including a first pair of locking ports in a first pair of adjacent side panels, proximate a common edge shared by the first pair of adjacent side panels, wherein the first pair of adjacent side panels include the side panel of the lid positioned opposite the hinge, and a second pair of locking ports in a second pair of adjacent side panels, proximate a common edge shared by the second pair of adjacent side panels, wherein the second pair of adjacent side panels also includes the side panel of the lid positioned opposite the hinge, wherein the container body includes two pairs of locking ports, including a first pair of locking ports in a first pair of adjacent sidewalls, proximate a common edge shared by the first pair of adjacent sidewalls, wherein the first pair of adjacent sidewalls include the sidewall of the container body positioned opposite the hinge, and a second pair of locking ports in a second pair of adjacent sidewalls, proximate a common edge shared by the second pair of adjacent sidewalls, wherein the second pair of adjacent sidewalls also includes the sidewall of the container body positioned opposite the hinge.

8. The elongated container according to claim 7, further including a locking means configured for secured insertion through the locking ports of the container body and the lid when registered.

9. The elongated container according to claim 7, wherein the top panel is structurally a continuous rectangular plane lacking voids.

10. The elongated container according to claim 7, wherein the container body includes a second pair of locking ports in an opposite, adjacent pair of the sidewalls, and the lid includes a second pair of locking ports in an opposite, adjacent pair of the side panels.

11. The elongated container according to claim 7, wherein the container body further includes a grip opening in at least one of the elongated sidewalls in a portion other than the top portion.

12. The elongated container according to claim 7, having a through-lid locking port through proximate both common edges of the side panel of the lid positioned opposite the hinge.

* * * * *